United States Patent [19]

Cheng

[11] Patent Number: 4,927,385

[45] Date of Patent: May 22, 1990

[54] CONNECTOR JACK

[76] Inventor: Yu F. Cheng, No. 7, Fu Hsing St., Tu Cheng Ind. Dist., Taipei Hsien, Taiwan

[21] Appl. No.: 380,314

[22] Filed: Jul. 17, 1989

[51] Int. Cl.[5] ..... H01R 13/00

[52] U.S. Cl. ..... 439/578

[58] Field of Search ..... 439/578–585

[56] References Cited

U.S. PATENT DOCUMENTS 3,845,453 10/1974 Hemmer ..... 439/578

4,666,232 5/1987 Thyu ..... 439/578

*Primary Examiner*—Joseph H. McGlynn

*Attorney, Agent, or Firm*—Connolly & Hutz

[57] ABSTRACT

A connector jack including a molded retainer, a conducting pin centrally located within the molded retainer, and a resilient clamping element. The molded retainer is a cylindrical body having a central recess at its front end for receiving an annular prong of a plug, two slots at its rear end thereof for receiving the resilient element, and a central stepped recess at its rear end and a perforation for receiving the conducting pin. The resilient clamping element has a conducting leg, a fixing leg and a T-shaped stem which connects the two legs. The two legs are insertable into the slots respectively. The conducting leg further includes a semicircular-shaped conducting end at its inner side which projects over the slot into the central recess.

3 Claims, 6 Drawing Sheets

CONNECTOR JACK

BACKGROUND OF THE INVENTION

The present invention relates to connector jacks, and more particularly, to a connector jack which provides a better connection with a plug.

One of the conventional connector jacks used in common electrical appliances for continuation of current source is generally shown in FIG. 6. Such conventional connector jacks generally include an insulating retainer 1*a* having a recess 11*a* for receiving the prong 2*b* of a plug, and a central conducting pin 12*a* projected from the base part of the insulating retainer 1*a* along a central axis of the recess 11*a*. The annular sidewall of the recess 11*a* is laminated with a copper plate 13*a*. When the prong 2*b* of the plug is inserted into the recess 11*a* of the connector jack, the central conducting pin 12*a* and the copper plate 13*a*, which are electrically connected with the two poles of the current source, enable the current source to be conveyed to the connector jack and the plug. Since the annular pole 21*b* of the prong 2*b* of common plugs is in surface contact with the copper plate 13*a* of such conventional connector jacks, the recess 11*a* may become enlarged easily after intensive use for a period of time. This results in a poor connection between the connector jack and the plug.

In addition, such conventional connector jacks require the annular sidewall of the recess 11*a* to be laminated with a copper plate 13*a* while the step of lamination of the copper plate 13*a* onto the annular sidewall complicates the manufacturing of the connector jack. Thus, this conventional connector jack cannot be produced economically.

The present invention is therefore intended to provide a connector jack which mitigates and/or obviates the above-mentioned drawbacks.

SUMMARY OF THE INVENTION

It is a primary object of the present invention to provide a connector jack which provides a better connection with a plug than was previously available.

Another object of the present invention is to provide a connector jack which provides for better connection with the plug even after an intensive use for a prolonged period of time.

A further object of the present invention is to provide a connector jack which can be manufactured in an economical manner.

Another object of the present invention is to provide a connector jack which includes a resilient clamping element, which is smaller than conventional copper plates and the resilient clamping element can be fitted readily in the connector jack.

Still another object of the present invention is to provide a connector jack having a plurality of fixing elements to impart a certain distance between the resilient clamping element and a central conducting pin so as to ensure good conduction between electric poles.

Further objects and advantages of the present invention will be apparent to those skilled in the art upon reading the description provided hereinbelow, with appropriate reference to the drawings.

DETAILED DESCRIPTION OF THE PREFERRED EMBODIMENT

Figure 1:
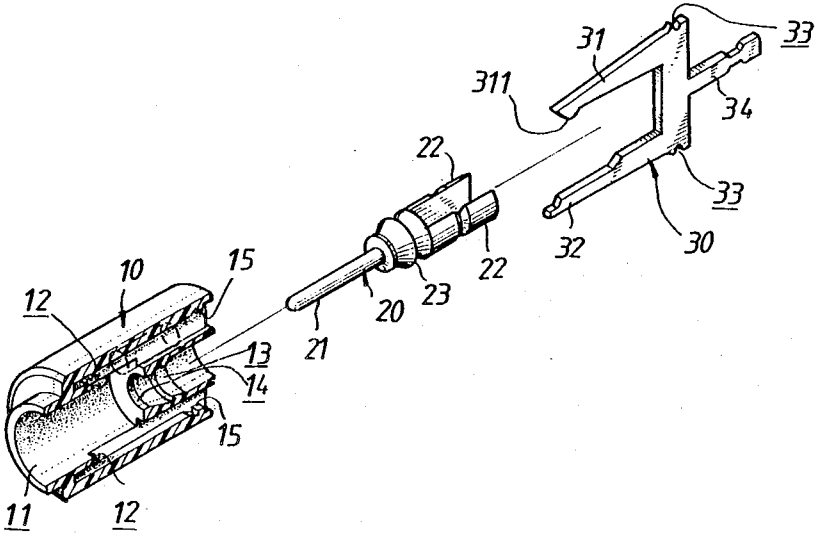
FIG. 1 is a perspective exploded view of a connector jack in accordance with the present invention, with a part of a molded retainer thereof cutaway for clarity.

Referring to the drawings and initially to FIG. 1, it can be seen that a connector jack in accordance with the present invention comprises a molded retainer 10, a conducting pin 20 which is centrally located within the molded retainer 10, and a resilient clamping element 30.

The molded retainer 10 has a structure which enables the conducting pin 20 and the resilient clamping element 30 to be located therein.

Figure 2:
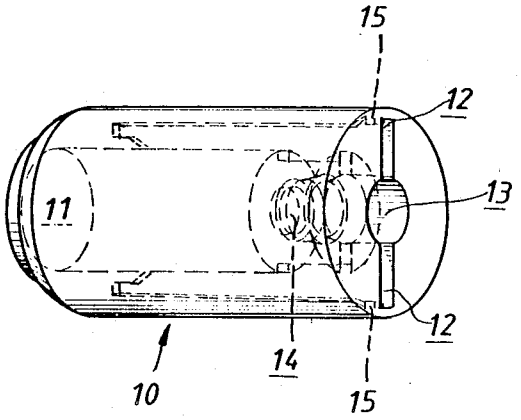
FIG. 2 is a perspective view of the molded retainer of the connector jack with the internal structure of the molded retainer shown in phantom lines.
Figure 5:
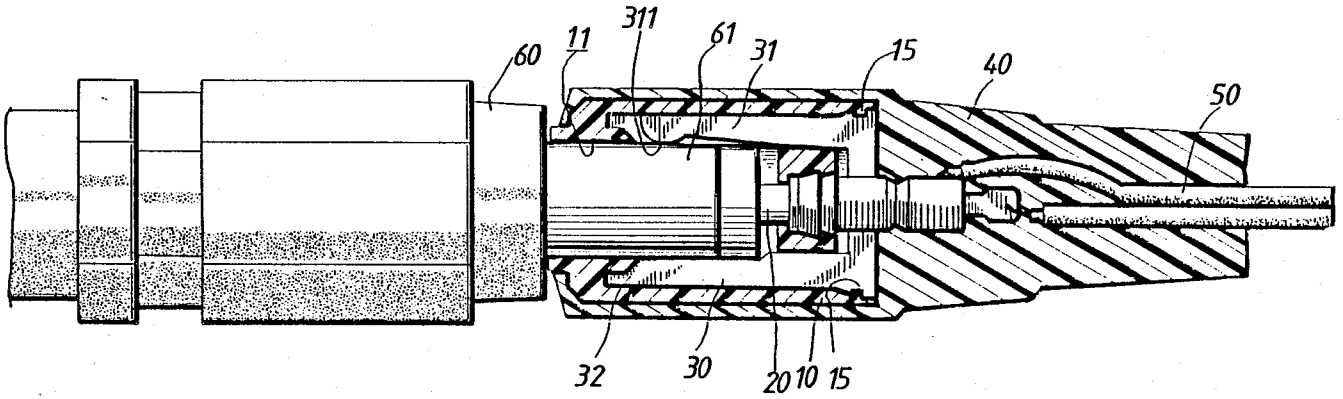
FIG. 5 is a sectional view of the connector jack shown in FIG. 1, with a plug inserted therein.
Figure 6:
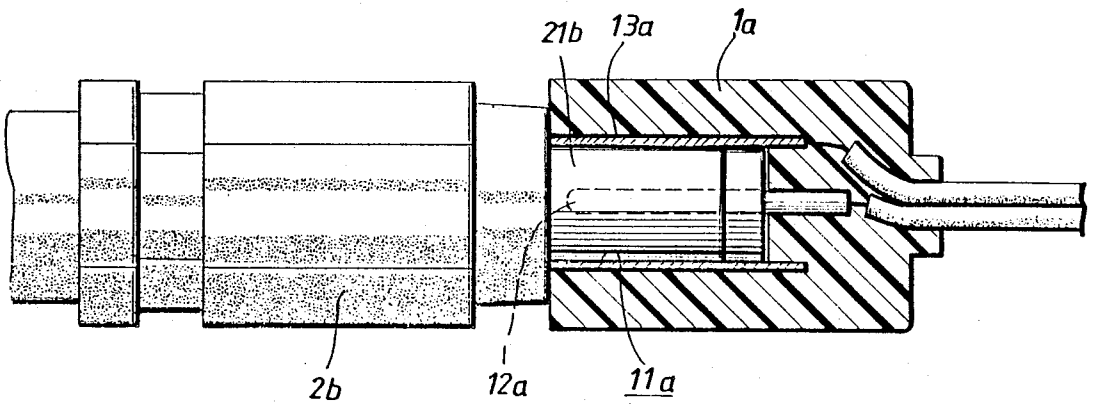
PRIOR ART FIG. 6.
FIG. 6 is a sectional view of a conventional connector jack with a plug inserted therein.

Further referring to FIG. 2, it can be seen that the molded retainer 10 is preferably a cylindrical body that includes a central recess 11 at a front end thereof for receiving the annular prong of a plug (see FIG. 5). The molded retainer 10 further includes two slots 12 at a rear end thereof for receiving two legs of the resilient clamping element 30. The molded retainer 10 further includes a central stepped recess 13 at the rear end thereof for receiving the conducting pin 20. A perforation 14 is formed on the base of the stepped recess 13 for a pin body 21 of the conducting pin 20 to pass through. Preferably, the sidewall of the molded retainer 10 at the position corresponding to each slot 12 is formed with a protrusion 15 to match respective cutout of the resilient clamping element 30 to prevent axial movement thereof along the slots 12 so that the clamping element 30 is fixable firmly in the slots 12 of the molded retainer 10.

Referring back to FIG. 1, the conducting pin 20, which is centrally located within the molded retainer 10, includes a pin body 21, two conducting arms 22 formed parallel with the pin body 21, and a pin-neck 23 which connects the two conducting arms 22 to the pin body 21. The pin-neck 23 has a stepped profile.

Still referring to FIG. 1, the resilient clamping element 30 which is firmly fixable in the slots 12 of the molded retainer 10 includes, as has been mentioned previously, two legs and two cutouts formed on the two legs. The first leg is a conducting leg 31 while the second leg is a fixing leg 32. The conducting leg 31 further includes a smoothly formed semicircular-shaped conducting end 311 at an inner side thereof. Both legs 31 and 32 are respectively formed with a cutout 33 for fixing purposes. The resilient clamping element 30 further includes a T-shaped stem 34. The shorter side of the T-shaped stem 34 connects the two legs 31 and 32 of the resilient clamping element 30 while the longer side of the T-shaped stem 34 is connected to the current source, such as a wire 50, as in FIG. 3.

As is general, an insulative cover, for example a plastic cover 40, (see FIGS. 3 and 5) is employed to enclose the assembled connector jack.

Figure 3:
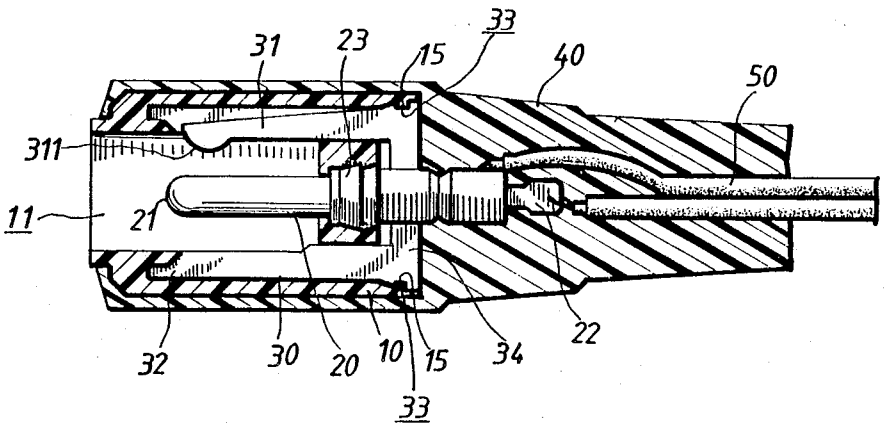
FIG. 3 is a sectional view of the connector jack shown in FIG. 1.
Figure 4:
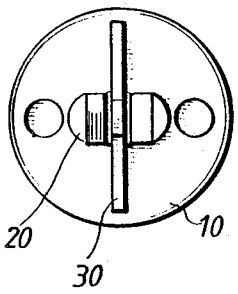
FIG. 4 is a rear view of the connector jack of FIG. 1.

With particular reference to FIGS. 3 and 4, the way the three components, namely, the molded retainer 10, the conducting pin 20 and the resilient clamping element 30 are fabricated can be understood.

The conducting pin 20 is initially inserted into the central stepped recess 13 with the pin body 21 of the conducting pin 20 passing through the perforation 14 and being retained in the central recess 11, and also with the pin-neck 23 retained in the stepped recess 33. After the assembly of the conducting pin 20, the resilient clamping plate 30 is then fitted to the molded retainer 10 with the shorter side of the T-shaped stem straddled over the two conducting arms 22 of the conducting pin 20. The two legs 31 and 32 of the resilient clamping element 30 are then urged into the two slots 12 of the molded retainer 10 with the cutouts 33 of the two legs 31 and 32 receiving respective protrusion 15 to prevent axial movement thereof the slots 12. After the insertion of the two legs 31 and 32 into respective slots 12, the smoothly formed semicircular-shaped conducting end 311 of the conducting leg 31, as shown in FIG. 3, projects over the slot 12 into the central recess 11. The smoothly formed semicircular-shaped conducting end 311 enables a tight engagement between the conducting leg 31 and the annular prong 61 of a plug 60, as shown in FIG. 5.

Although the clearance between each of the conductive arms 22 and the oppositely polarized stem 34 may be as little as 0.9 millimeters, it is not necessary to insert an insulator in that clearance, particularly where the individual parts are manufactured to close tolerances and are locked in piece as a rigid assembly. As a further assurance, the arms 22 can be spread apart after the assembly so that the outermost portions of each arm is about 1.5 millimeters away from the stem 34. The grooving around the arms facilitates such spreading.

Alternatively, a U-shaped thin piece of sheet or molded insulation can be fitted over stem 34 before element 30 is assembled into element 10.

While the present invention has been described with respect to a preferred embodiment of the invention, it will be understood by those skilled in the art after understanding the invention, that changes and modifications may be made without departing from the spirit and the scope of the invention defined by the following claims.

I claim:

1. A connector jack comprising:

a molded retainer (10) having a cylindrical body including a central recess (11) at a front end thereof for receiving an annular prong of a plug, two slots (12) at a rear end thereof, a central stepped recess (13) at the rear end thereof, and a perforation (14) formed on a base of said stepped recess (13);

a conducting pin (20) centrally located within said molded retainer (10), said conducting pin (20) including a pin body (21), two conducting arms (22) formed in parallel with said pin body (21), and a pin-neck (23) which connects the two conducting arms (22) to said pin body (21), said pin-neck (23) having a stepped profile, said conducting pin (20) being insertable into said central stepped recess (13) with said pin body (21) passing through said perforation (14) and being retained in said central recess (11), said pin-neck (23) being retained in said stepped recess (33); and a resilient clamping element (30) including a conducting leg (31) and a fixing leg (32) and a T-shaped stem (34) which connects said conducting leg (31) and said fixing leg (32), said conducting leg (31) and said fixing leg (32) being respectively insertable into said slots (12) of said molded retainer (10), said conducting leg (31) further including a semicircular-shaped conducting end (311) at an inner side thereof, said semicircular-shaped conducting end (311) projecting over said slot (12) into said central recess (11).

2. A connector jack as claimed in claim 1, wherein a sidewall of said molded retainer (10) at a position corresponding to each slot (12) is formed with a protrusion (15).

3. A connector jack as claimed in claim 2, wherein said conducting leg (31) and said fixing leg (32) are formed with respective cutout (33) for engagement with said protrusions (15).

* * * * *